US008220684B1

(12) United States Patent
Keily et al.

(10) Patent No.: US 8,220,684 B1
(45) Date of Patent: Jul. 17, 2012

(54) APPARATUS FOR DISPENSING PAPER TOWELING

(75) Inventors: Joel P. Keily, Corona, CA (US); Niko Anthony Cvjetkovic, La Palma, CA (US); Charles Parkin Davis, Torrance, CA (US)

(73) Assignee: Dispensing Dynamics International, City of Industry, CA (US)

( * ) Notice: Subject to any disclaimer, the term of this patent is extended or adjusted under 35 U.S.C. 154(b) by 385 days.

(21) Appl. No.: 12/658,235

(22) Filed: Feb. 4, 2010

(51) Int. Cl.
*B26F 3/02* (2006.01)

(52) U.S. Cl. ..... 225/20; 225/19; 225/39

(58) Field of Classification Search ..... 225/19, 225/20, 23, 39
See application file for complete search history.

(56) References Cited

U.S. PATENT DOCUMENTS

| | | | | |
|---|---|---|---|---|
| 293,349 | A * | 2/1884 | Newbury | 225/39 |
| 525,335 | A * | 9/1894 | Clark | 225/39 |
| 2,954,910 | A * | 10/1960 | Moncrieff | 225/20 |
| 3,175,744 | A * | 3/1965 | Sumida | 225/39 |
| 3,190,520 | A * | 6/1965 | Wyant | 225/39 |
| 3,707,251 | A * | 12/1972 | Dashnier et al. | 225/21 |
| 4,579,267 | A * | 4/1986 | Planke | 225/54 |
| 5,024,362 | A * | 6/1991 | Karlsson | 225/20 |
| 5,161,723 | A * | 11/1992 | Wirtz-Odenthal | 225/14 |
| 6,749,097 | B1 * | 6/2004 | McElhinny | 225/20 |
| 8,083,114 | B1 * | 12/2011 | Steele et al. | 225/20 |

* cited by examiner

*Primary Examiner* — Sean Michalski
(74) *Attorney, Agent, or Firm* — Thomas R. Lampe

(57) ABSTRACT

Apparatus for dispensing paper toweling from a roll of paper toweling includes structure including a fixed cutter blade and a toweling support tray at the toweling exit opening which makes it difficult to "milk" toweling from the dispenser.

10 Claims, 4 Drawing Sheets

APPARATUS FOR DISPENSING PAPER TOWELING

TECHNICAL FIELD

This invention relates to apparatus for dispensing paper toweling having a tail from a roll of paper toweling. More particularly, the apparatus incorporates a fixedly mounted tear blade enabling a user to tear a sheet from the paper toweling and structure preventing "milking" of the toweling by a user.

BACKGROUND OF THE INVENTION

It is well known to employ fixed mounted tear or cutter blades in paper towel dispensers. Typically, these blades are located at or near a toweling exit opening of the dispenser.

A common problem in many conventional prior art dispenser constructions employing fixed tear or cutter blades is that of "milking" of the toweling by the end user. That is, in conventional arrangements a user can pull the toweling down continuously without tearing it on the tear blade (allowing milking) because there is no structure requiring that the toweling push against the tear blade.

DISCLOSURE OF INVENTION

The present invention incorporates structural elements which cooperate to prevent milking when a user pulls on the sheet. Furthermore, the structural combination of this invention promotes more positive engagement between the toweling and the cutting blade, thus providing more efficient dispensing as well as preventing waste of toweling.

The apparatus of the present invention is for dispensing paper toweling having a tail from a roll of paper toweling. The apparatus has a toweling exit opening.

The apparatus includes a dispenser housing having a housing front and defining a housing interior in communication with the toweling exit opening.

An elongated toweling support roller is within the housing interior for receiving and supporting toweling extended from a roll of paper toweling in the housing interior.

A tear blade is positioned adjacent to the exit opening. The tear blade is spaced from the toweling support roller and extends lengthwise along the toweling support roller.

Toweling guide structure is operatively associated with the toweling support roller and with the tear blade. The toweling guide structure is movable between a first condition wherein the toweling guide structure maintains toweling transported by the toweling support roller out of engagement with the tear blade and a second condition wherein the toweling guide structure allows engagement of the toweling transported by the toweling support roller with the tear blade.

The toweling guide structure moves from the first condition to the second condition responsive to a manually exerted pulling force on the tail of the toweling extending from the exit opening in a direction moving said toweling and said toweling guide structure away from the toweling support roller and toward the tear blade. The toweling guide structure returns to the first condition responsive to severance of the toweling by the tear blade.

Other features, advantages and objects of the present invention will become apparent with reference to the following description and accompanying drawings.

MODES FOR CARRYING OUT THE INVENTION

Figure 2:
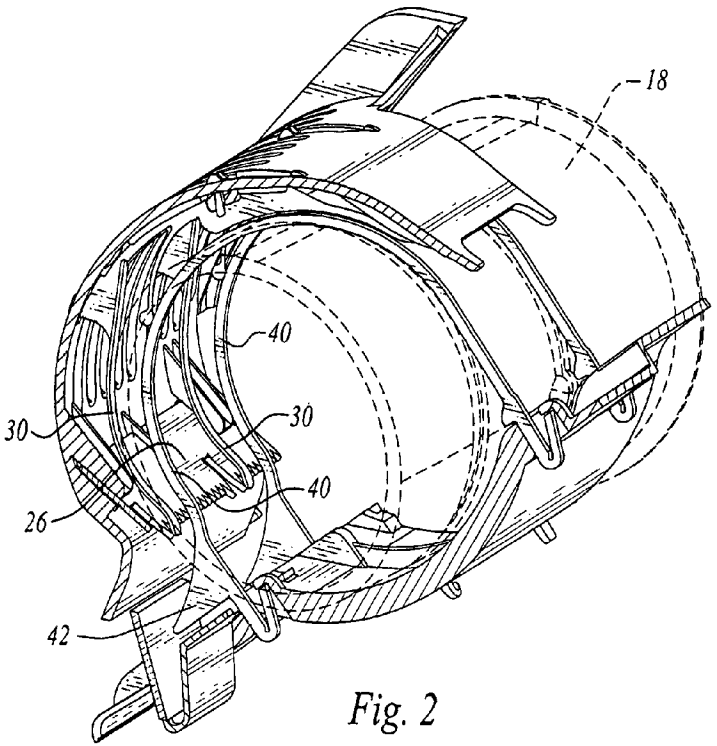
FIG. 2 is an enlarged, perspective, sectional view illustrating the apparatus and its relationship to a toweling support roller, the latter being shown in broken lines.
Figure 1:
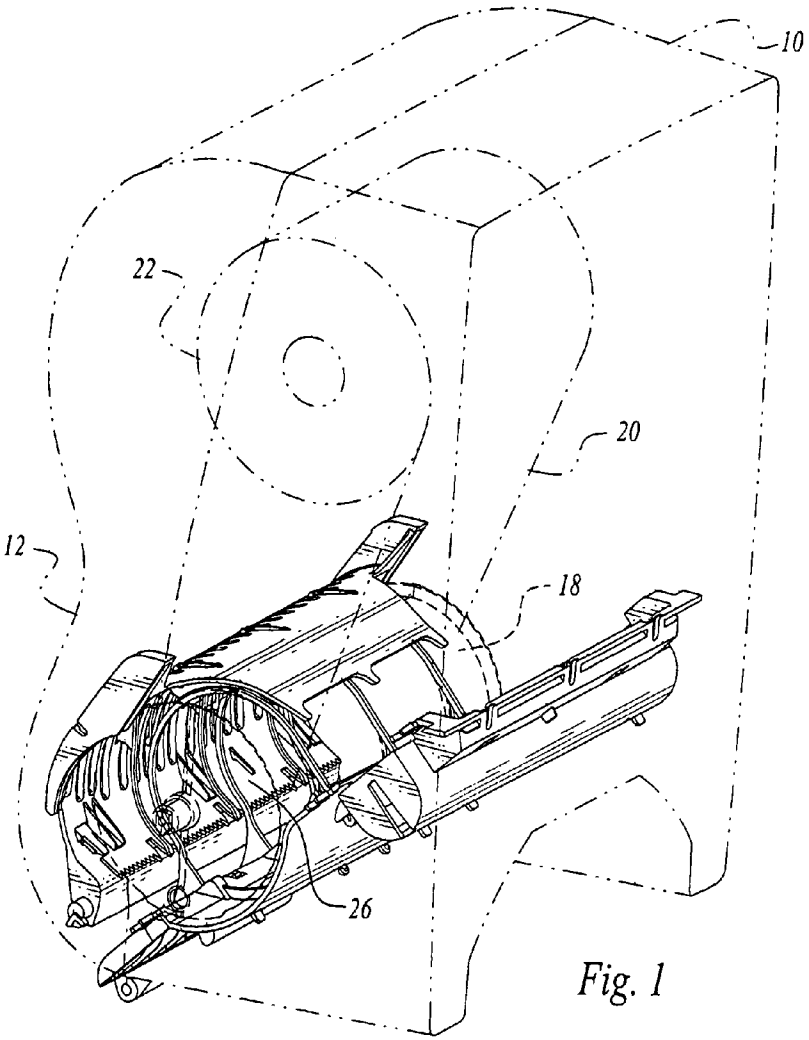
FIG. 1 is a perspective view illustrating apparatus constructed in accordance with the teachings of the present invention disposed inside a housing, the housing, a roll of paper toweling within the housing and a toweling support roller shown in broken lines.

Referring now to FIGS. 1-8, apparatus constructed in accordance with the teachings of the present invention is illustrated. The apparatus is for dispensing paper toweling having a tail from a roll of paper toweling. The apparatus includes a dispenser housing 10 having a front 12 and defining a housing interior 14. The housing interior is in communication with an apparatus exit opening 16 located at the bottom of the housing front.

A rotatable, elongated toweling support roller or drum 18 is disposed within the housing interior for receiving and supporting paper toweling 20 extending from a roll 22 of paper toweling in the housing interior. The structure thus far indicated and as generally described is well known in the prior art.

A tear blade 26 is fixedly positioned adjacent to the exit opening 16. The tear blade 26 is spaced from the toweling support roller 18 and extends lengthwise along the toweling support roller. Tear blades of both fixed and movable character are well known in the towel dispensing art, however the tear blade 26 has a unique structure and cooperative relationship with other structural elements of the present invention.

As is described in greater detail below, toweling guide structure of a unique character is operatively associated with the toweling support roller and with the tear blade. The toweling guide structure is movable between a first condition wherein the toweling guide structure maintains toweling transported by the toweling support roller out of engagement with the tear blade 26 and a second condition wherein the toweling guide structure allows engagement of the toweling transported by the toweling support roller with the tear blade. The toweling guide structure moves from the first condition to the second condition responsive to a manually exerted pulling force on the tail of the toweling extending from the exit opening 16 in a direction moving the toweling and the toweling guide structure away from the toweling support roller and toward the tear blade. The toweling guide structure returns to the first condition responsive to severance of the toweling by the tear blade.

Figure 4:
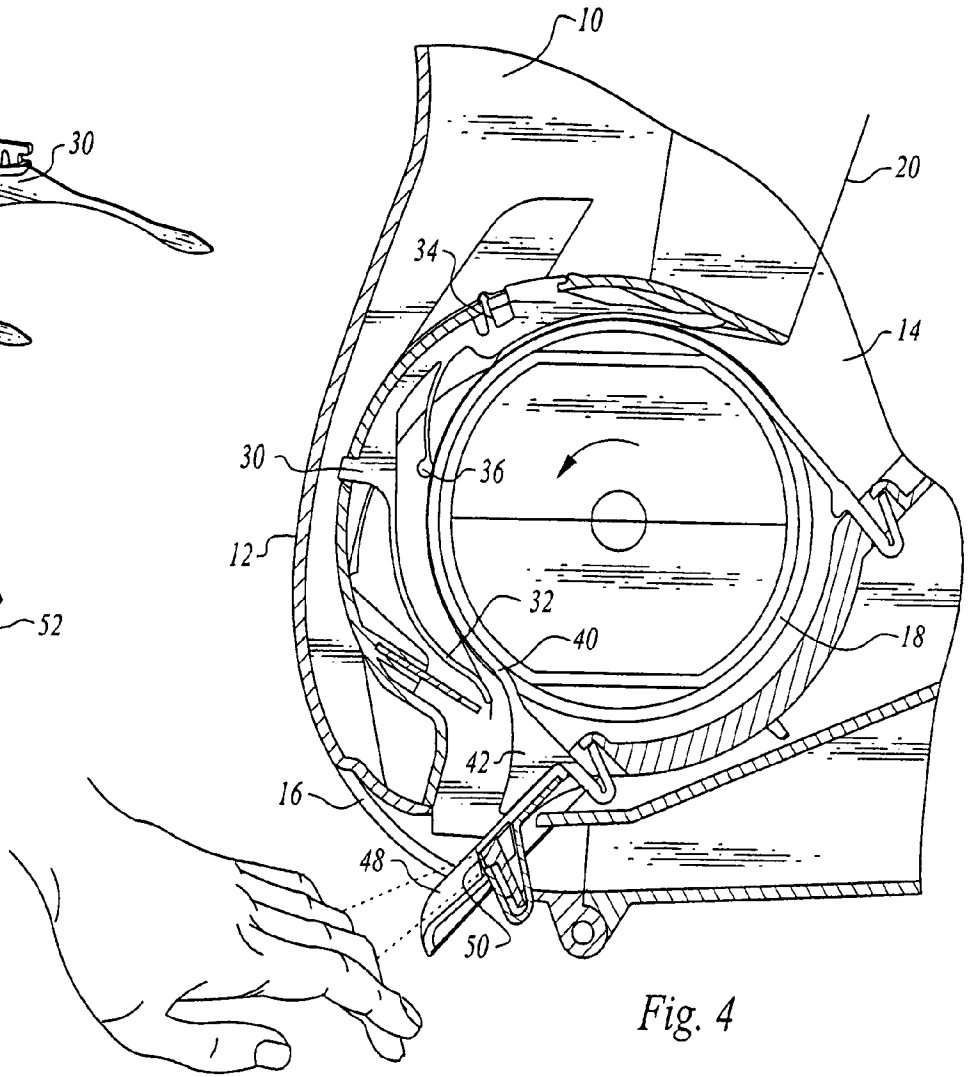
FIG. 4 is a side, elevational view of the apparatus illustrating a portion of the cabinet, the rotatable toweling support roller, and a sensor sensing positioning of a user's hand.
Figure 3:
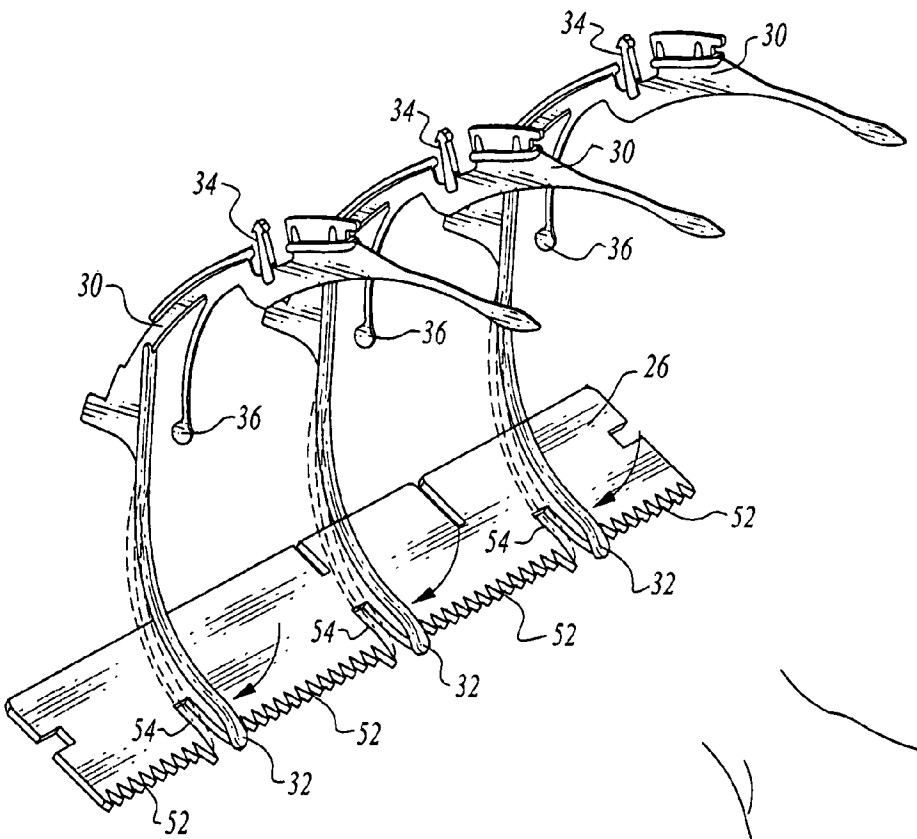
FIG. 3 is an enlarged, perspective view illustrating a tear blade and toweling guide structure of the invention, flexible fingers of the toweling guide structure being shown in alternative conditions, by solid and dash lines.

The toweling guide structure is in the form of a plurality of flexible fingers 30 formed of plastic or other suitable material, the fingers being engageable by the toweling 20. The fingers 30 are spaced from one another and include distal end portions 32 alternatively movable toward or away from the tear blade 26. This action is shown in FIG. 3 for example. The upper portions of the fingers are attached by snap connectors 34 to the housing 10 and extend downwardly partially about the periphery of the toweling support roller. In the arrangement illustrated, projections 36 of the fingers engage the toweling on the roller 18 to maintain engagement therebetween. FIG. 4 and the solid line depiction of FIG. 3 show the normal position or condition of the fingers 30 relative to the tear blade 26 and roller 18.

Roller stripper structure in the form of a plurality of stripper elements 40 is connected to the housing and the stripper elements extend about a portion of the periphery of the roller 18 adjacent to the flexible fingers 30. The flexible finger distal end portions 32 and the stripper elements 40 define restricted toweling passageways receiving the toweling transported by the toweling support roller.

The roller stripper elements 40 are positioned in grooves formed in the roller and include curved stripper element portions 42 engageable with the toweling transported by the toweling support roller to direct the toweling toward the exit opening 16.

Figure 5:
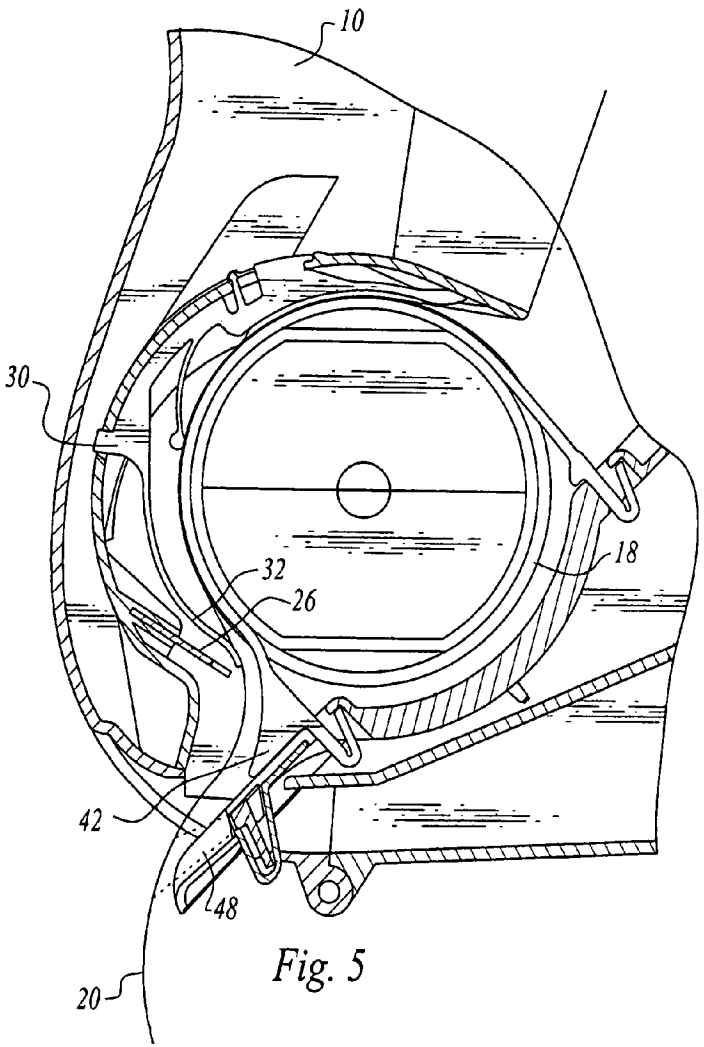
FIG. 5 is a view similar to FIG. 4, but illustrating a tail of paper toweling extending from an exit opening of the apparatus, having been placed in that position responsive to actuation by a user's hand as shown in FIG. 4.

FIG. 4 shows the roller 18 rotating responsive to the signal from a hand position sensor to deliver the toweling tail toward the exit opening. FIG. 5 shows the rotation of the roller stopped and the tail extending from the bottom of the exit opening and available for manual grasping by the user. It is to be noted that the curved stripper element portions 42 are located below the level of tear blade 26.

A toweling support tray 48 is connected to the dispenser housing. The tray extends below the tear blade 26 and into exit opening 16. In this embodiment of the invention the hand sensor, which may be of any suitable known type commonly employed in paper toweling dispensers, such as an infrared sensor, is located at toweling support tray 48, the sensor being designated by reference numeral 50. A motor (not shown) associated with toweling support roller 18 is actuated by sensing of a user's hand, with suitable conventional electrical circuitry or electronics being utilized to control the amount of rotation of the roller. Such controls generally are widely known and utilized in the paper towel dispensing art, and need not be described here.

Tear blade 26, as indicated above, is fixedly attached to the housing 10. The tear blade has a unique character. The tear blade cutting edge includes a plurality of toweling cutting teeth 52 between spaced blade openings or slots 54 which extend from the cutting edge. These openings 54 receive the flexible finger distal end portions 32 when the toweling guide structure is in the second condition described above.

Figure 6:
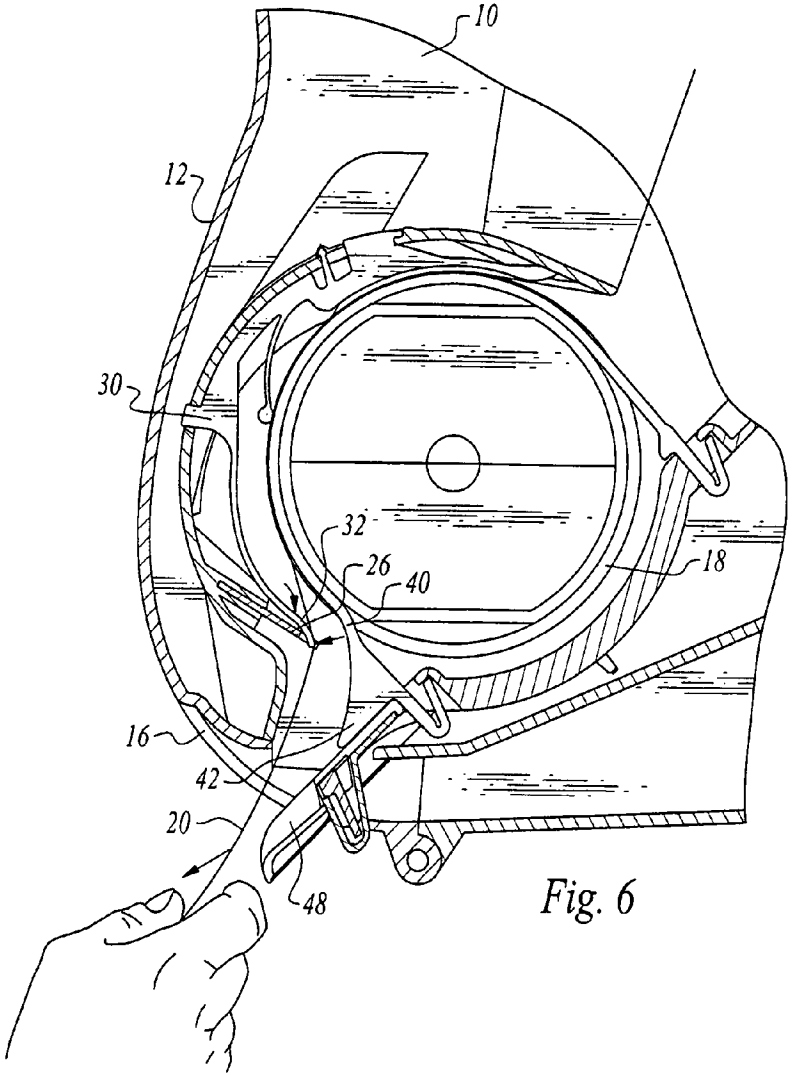
FIG. 6 is a view similar to FIGS. 4 and 5, but illustrating a user's hand grasping the tail of the toweling to force the toweling against the apparatus tear blade.

FIG. 6 shows the user exerting a manual pulling force on the toweling extending downwardly from the exit opening 16. It is important to note that the user can only pull the toweling toward the front of the housing as indicated by the arrow just above the user's hand in FIG. 6. This causes the fingers 30 to flex and move to the positions indicated by dash lines in FIG. 3 wherein the flexible finger distal end portions 32 move into blade openings 54 and ensure a forceful engagement between the toweling being pulled and the teeth of the cutter or tear blade 26. FIG. 6 indicates such action by means of arrows.

Figure 7:
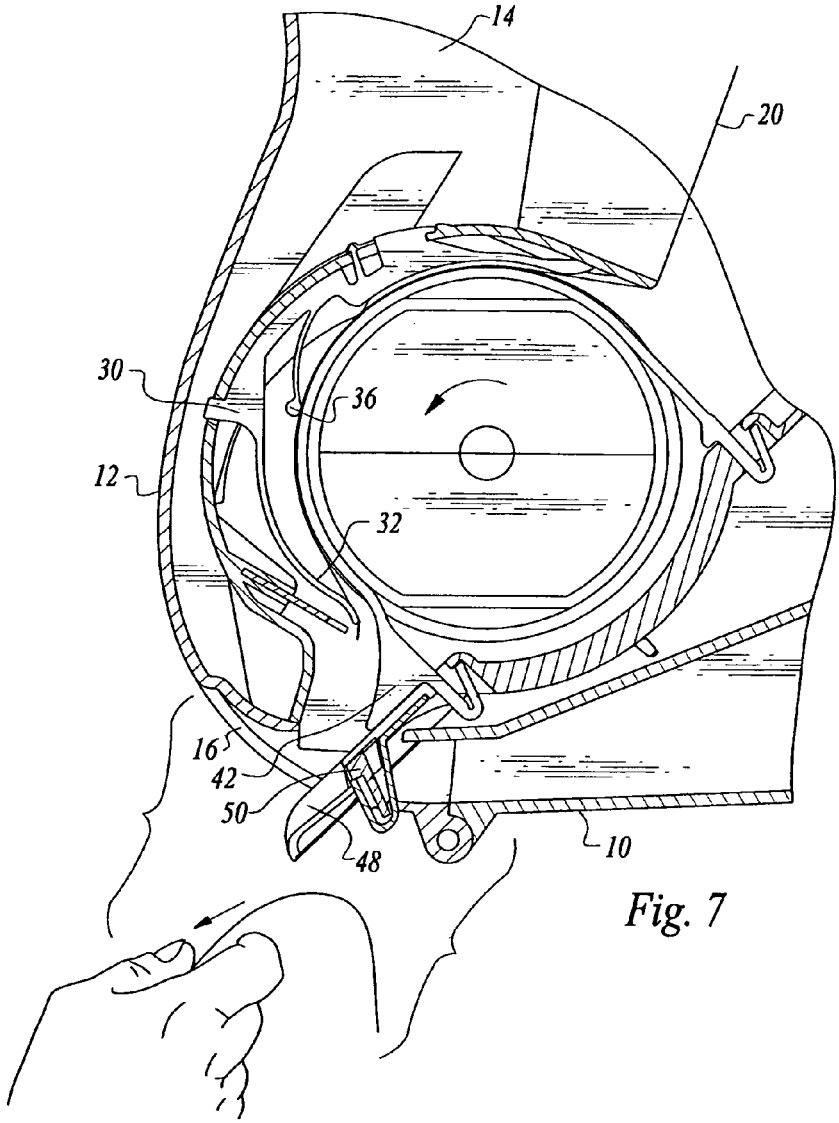
FIG. 7 is a view similar to FIGS. 4-6, but illustrating a sheet of toweling having been severed and removed by the user.
Figure 8:
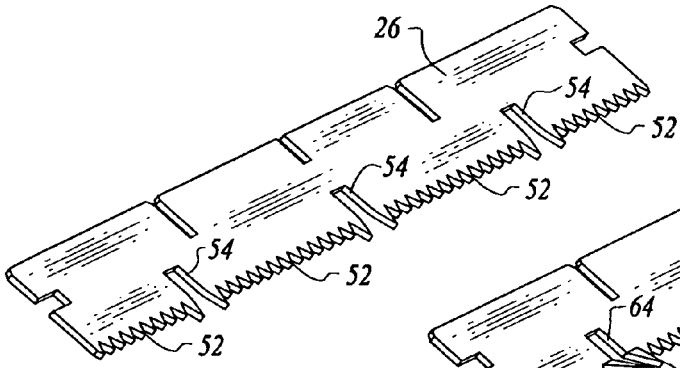
FIG. 8 is a perspective view of the tear blade of the apparatus.

A clean positive cut of the toweling will thus take place and the user can readily remove the severed end of the toweling or sheet as shown in FIG. 7. Once this occurs, the fingers will return to their normal positions as indicated in FIG. 7, for example, as well as in the solid line depiction of the fingers in FIG. 3.

The relative positions of the tear blade, the toweling support tray below the tear blade within the exit opening and the toweling coming off the roller 18 requires that the pulling force exerted on the tail of the toweling extending from the exit opening by a user of the apparatus will, in addition to forcing the toweling against the tear blade, act to prevent milking of the toweling by the user. Without the configuration including the extended toweling support tray 48, the toweling, rather than being pulled forward at the location of the tear blade could be pulled downwardly, enabling milking by a user. Without such feature a vandal could quickly dispense and waste paper.

Figure 9:
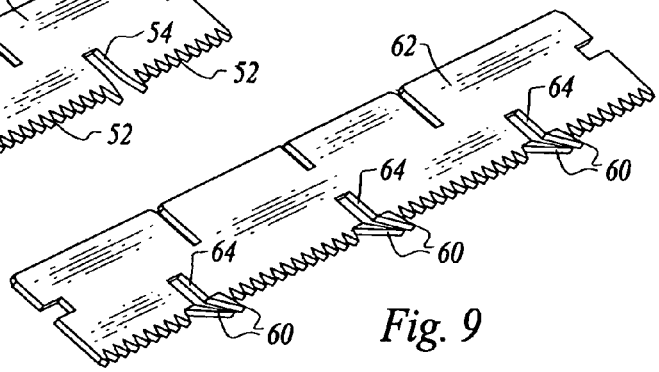
FIG. 9 is a perspective view illustrating an alternative embodiment of tear blade.

It will be noted that the cutting teeth 52 of tear blade 26 are substantially co-planar. FIG. 9 shows an alternative embodiment wherein cutting teeth 60 of tear blade 62 adjacent to blade openings 64 project upwardly from the other cutting teeth thereof. Cutting teeth 60 are longer than the other cutting teeth. This approach may provide enhanced anti-milking capability.

The invention claimed is:

1. Apparatus for dispensing paper toweling having a tail from a roll of paper toweling, said apparatus having a toweling exit opening and comprising, in combination:

a dispenser housing having a housing front and defining a housing interior in communication with said toweling exit opening;

a rotatable, elongated toweling support roller within said housing interior for receiving and supporting toweling extending from a roll of paper toweling in said housing interior;

a tear blade fixedly connected to said dispenser housing and including a cutting edge, said tear blade positioned adjacent to said exit opening, spaced from said toweling support roller and extending lengthwise along said toweling support roller; and toweling guide structure operatively associated with said toweling support roller and with said tear blade movable between a first condition wherein said toweling guide structure maintains toweling transported by said toweling support roller out of engagement with said tear blade and a second condition wherein said toweling guide structure allows engagement of the toweling transported by said toweling support roller with said tear blade, said toweling guide structure moving from said first condition to said second condition responsive to a manually exerted pulling force on the tail of the toweling extending from said exit opening in a direction moving said toweling and said toweling guide structure away from said toweling support roller and toward said tear blade, and said toweling guide structure returning to said first condition responsive to severance of said toweling by said tear blade, said toweling guide structure including a plurality of flexible fingers engageable by said toweling, said plurality of flexible fingers spaced from one another and including distal end portions alternatively movable toward or away from said tear blade, sail tear blade defining spaced blade openings extending inwardly from said cutting edge for receiving said flexible finger distal end portions when said toweling guide structure is in said second condition.

2. The apparatus according to claim 1 wherein said flexible fingers extend partially about the periphery of said toweling support roller.

3. The apparatus according to claim 1 additionally comprising roller stripper structure extending partially about the periphery of said toweling support roller adjacent to said plurality of flexible fingers, and said roller stripper structure and the flexible finger distal end portions defining restricted toweling passageways receiving the toweling transported by said toweling support roller.

4. The apparatus according to claim 3 wherein said roller stripper structure comprises a plurality of roller stripper elements spaced from one another and extending about a portion of the periphery of said toweling support roller adjacent to said flexible fingers, said roller stripper elements having curved stripper element portions engageable with toweling transported by said toweling support roller to direct said toweling toward said toweling exit opening.

5. The apparatus according to claim 4 wherein said curved stripper element portions are located below the level of said tear blade.

6. The apparatus according to claim 5 additionally comprising a toweling support tray connected to said dispenser housing, extending below said tear blade and into said exit opening whereby any pulling force exerted on the tail of the toweling extending from the exit opening by a user of the apparatus will force the toweling against said tear blade to prevent milking of the toweling by the user.

7. The apparatus according to claim 6 additionally comprising a hand sensor mounted at said toweling support tray.

8. The apparatus according to claim 1 wherein said tear blade cutting edge includes a plurality of toweling cutting teeth between said blade openings.

9. The apparatus according to claim 8 wherein said cutting teeth are substantially co-planar.

10. The apparatus according to claim 8 wherein cutting teeth adjacent to said blade openings project upwardly.

* * * * *